United States Patent [19]

Akers et al.

[11] 4,432,540

[45] Feb. 21, 1984

[54] MAIL SORTING MACHINE WITH IMPROVED CONVEYOR AND ENVELOPE SEPARATING DEVICE

[75] Inventors: Roy Akers, Johnson County; Charles R. Hartman, Douglas County; Keith B. Deutch, Johnson County, all of Kans.

[73] Assignee: Bell & Howell Company, Chicago, Ill.

[21] Appl. No.: 231,593

[22] Filed: Feb. 5, 1981

[51] Int. Cl.[3] ..... B65H 3/04

[52] U.S. Cl. ..... 271/8 A; 271/34; 271/94; 271/149; 271/155; 271/179

[58] Field of Search ..... 271/34, 121, 124, 149, 271/154, 155, 167, 8 A, 30 A, 94, 96, 104, 149, 179, 113

[56] References Cited

U.S. PATENT DOCUMENTS

| | | | |
|---|---|---|---|
| 650,410 | 5/1900 | Morin | 271/121 |
| 814,943 | 3/1906 | Cook . | |
| 823,892 | 6/1906 | Parker . | |
| 874,982 | 12/1907 | Horton . | |
| 979,200 | 12/1910 | Prosser . | |
| 1,484,248 | 2/1924 | Austin . | |
| 1,773,321 | 8/1930 | Schaffner . | |
| 2,400,667 | 5/1946 | Toews . | |
| 2,575,813 | 11/1951 | Hutchins . | |
| 2,742,286 | 4/1956 | Williams et al. . | |
| 2,784,835 | 3/1957 | Dixon . | |
| 2,815,850 | 12/1967 | Davis . | |
| 2,909,271 | 10/1959 | Taylor . | |
| 2,925,165 | 2/1960 | Rake . | |
| 3,025,052 | 3/1962 | Gutteling | 271/104 X |
| 3,193,280 | 7/1965 | Gutierrez | 271/2 |
| 3,198,514 | 8/1965 | Barbera | 271/34 X |
| 3,226,109 | 12/1965 | Thompson | 271/34 |
| 3,237,757 | 3/1966 | Perkins . | |
| 3,253,692 | 5/1966 | Ota . | |
| 3,260,520 | 7/1966 | Sugden | 271/104 X |
| 3,285,389 | 11/1966 | Kaplan . | |
| 3,347,348 | 10/1967 | Flint | 271/2 X |
| 3,386,574 | 6/1968 | Kaplan . | |
| 3,468,531 | 9/1969 | Whittington | 271/149 |
| 3,661,245 | 5/1972 | Mol . | |
| 3,682,473 | 8/1972 | Kuyt | 271/149 X |
| 3,735,976 | 5/1973 | Watson . | |
| 3,841,471 | 10/1974 | Mead . | |
| 3,857,478 | 12/1974 | Meeusen . | |
| 4,295,645 | 10/1981 | Nahar | 271/34 |
| 4,299,379 | 11/1981 | Preston | 271/149 X |
| 4,345,752 | 8/1982 | Nakamura | 271/104 X |

*Primary Examiner*—Richard A. Schacher

*Attorney, Agent, or Firm*—Kokjer, Kircher, Bradley, Wharton, Bowman & Johnson

[57] ABSTRACT

A high speed mail sorting machine which includes an improved screw conveyor in the magazine section and an improved pick off device for separating the individual envelopes from one another. The screw conveyor includes four driven rollers having spiral grooves for receiving the lower edges of the envelopes to convey them along the rollers. A pair of raised rollers with spiral grooves maintain the envelopes in a vertical orientation as they are conveyed along the lower rollers. The pick off device includes a conveyor belt and a relatively strong vacuum box which draws the leading envelope against the belt. An opposing vacuum box of lesser intensity draws any stuck envelopes away from the leading envelope to assure separation. The opposing vacuum box has a beveled surface which effects a staggered shingle arrangement of any extra envelopes adhering to the leading envelope.

6 Claims, 8 Drawing Figures

MAIL SORTING MACHINE WITH IMPROVED CONVEYOR AND ENVELOPE SEPARATING DEVICE

BACKGROUND AND SUMMARY OF THE INVENTION

This invention relates to improvements in high speed mail sorting equipment of the type disclosed in pending patent application Ser. No. 973,926, filed Dec. 28, 1978 in the name of Roy Akers now U.S. Pat. No. 4,275,875 issued June 30, 1981.

One of the major problems associated with high speed mail sorting machines is to assure that the envelopes are properly separated from one another for individual handling. If two or more envelopes stick together and are advanced together through the machine rather than individually, they are deposited incorrectly in the same sorting bin. The jogger arm mechanism shown in the aforementioned Akers application represents one approach to this problem that has proven to be successful for the most part. Nevertheless, the jogger arms rely on shaking the entire supply stack of envelopes rather than providing positive separation of the envelopes from one another, and the effectiveness of the separation suffers accordingly.

Another problem in this type of equipment is to maintain the envelopes in the magazine oriented properly to be picked off at the envelope feed station. As shown in the Akers application, the magazine is typically provided with a carriage which rides on conveyor belts to advance the envelope supply toward the feed station. Switches at the feed station sense the presence or absence of envelopes and control the conveyor motor accordingly. The carriage compresses the envelopes rather firmly, and the envelopes are thus subjected to possible wrinkling or other damage unless they are initially organized in a neatly arranged stack. Also, if the carriage of a significant quantity of envelopes become skewed in the magazine, the leading envelope can be skewed or otherwise improperly oriented such that it is not picked off properly by the suction belt arrangement at the envelope feed station.

It is the primary goal of the present invention to provide a mail sorting machine having an improved pick off device for separating the individual envelopes and an improved conveyor in the magazine section of the machine for delivering the envelopes to the pick off device in the proper orientation for effective separation.

In accordance with the invention, the magazine section of the machine is equipped with a screw conveyor having four parallel rollers with spiral grooves for receiving the lower edges of the envelopes which are loaded in the magazine. A pair of raised rollers with identical spiral grooves engage the ends of the envelopes to maintain them each in a vertical orientation as they travel along the conveyor. As the envelopes approach the feed station located at the end of the magazine, they contact switch arms which control the drive motors of the rollers in a manner to assure that the envelopes are not skewed. The envelopes are thus conveyed along the magazine in the proper orientation and are not crushed tightly against one another as occurs in other types of conveyors.

The pick off device includes a pair of belts and an associated vacuum box which draws the leading envelope against the belts. An extra envelope adhering to the leading envelope is exposed to a second vacuum box and drawn by it away from the belts until the leading envelope clears the first vacuum box, at which time the extra envelope is drawn against the belts by the stronger suction force of the first vacuum. The impact surface of the second vacuum box is beveled to provide "shingling" of the envelopes if more than one extra envelope sticks to the leading envelope. The overall result is that the individual envelopes are effectively separated from the stack and do not stick together as they are advanced through the machine and eventually deposited in the appropriate bins.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
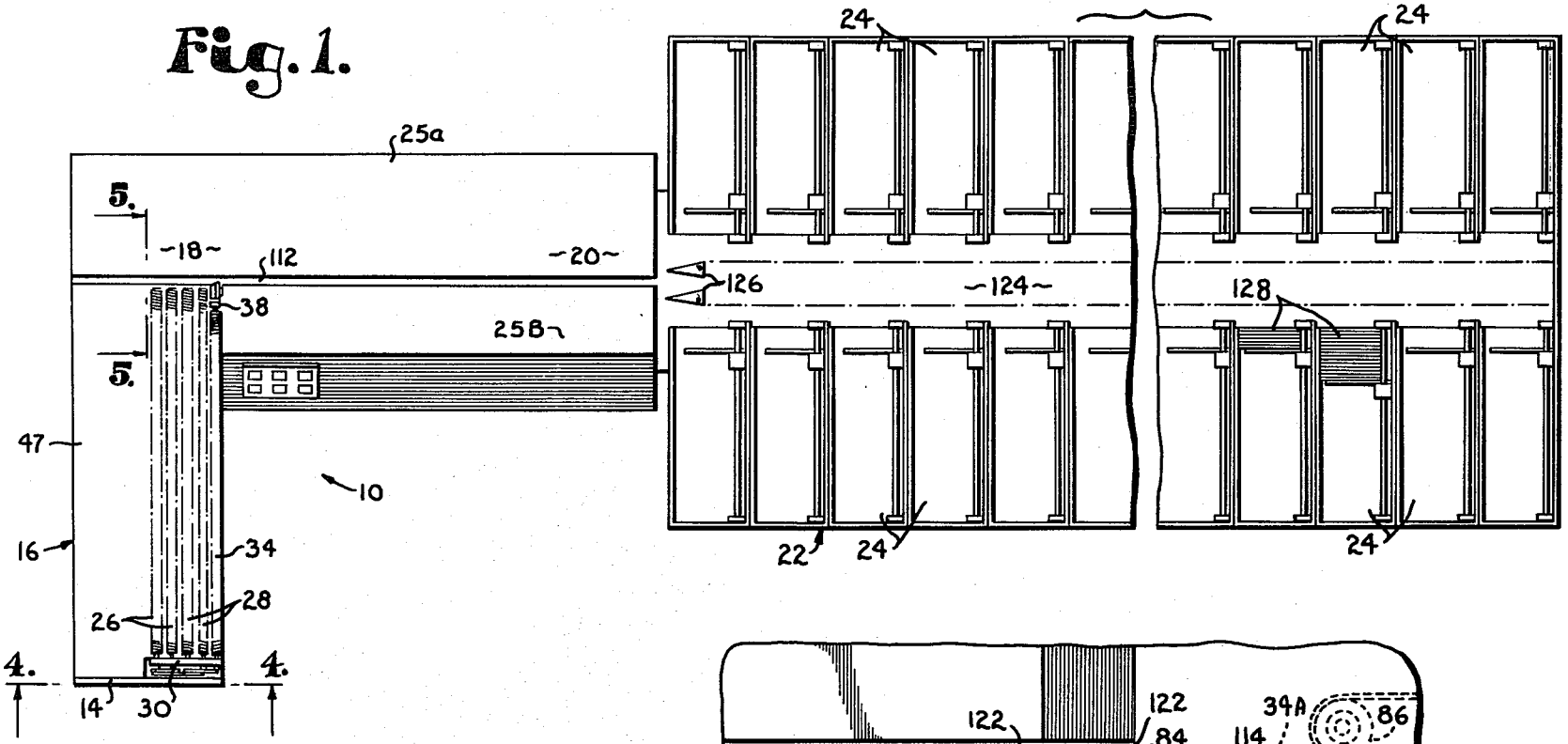
FIG. 1 is a top plan view of a mail sorting machine constructed according to a preferred embodiment of the present invention, with the break lines indicating continuous length.

Referring now to the drawings in more detail and initially to FIG. 1, numeral 10 generally designates a high speed mail sorting machine constructed in accordance with the present invention. The mail sorting machine 10 is of the same general type as that disclosed in pending patent application Ser. No. 973,926, filed Dec. 28, 1978 in the name of Roy Akers, which application is incorporated herein by reference.

Figure 4:
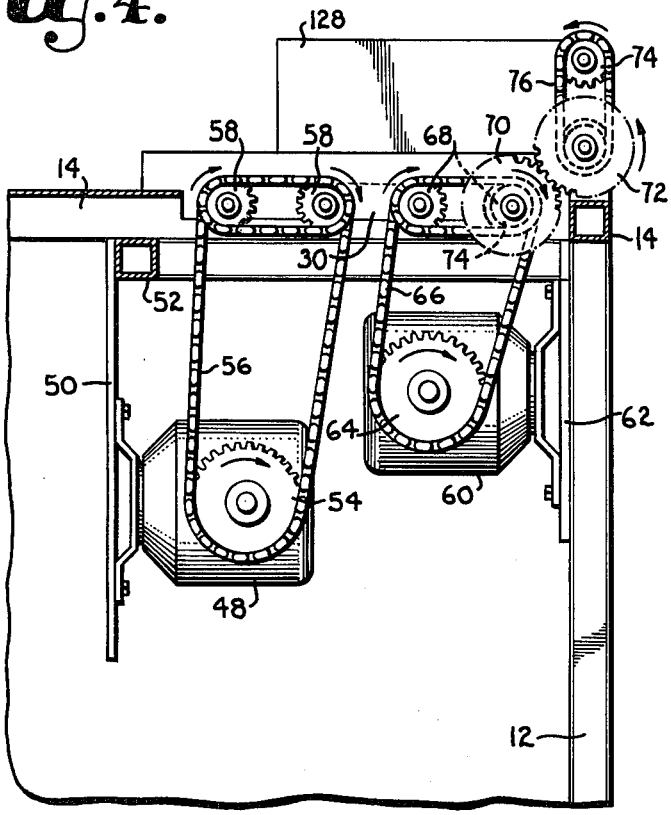
FIG. 4 is a fragmentary elevational view on an enlarged scale taken generally along line 4—4 of FIG. 1 in the direction of the arrows.

The frame of the machine includes a plurality of vertical legs, one of which is indicated at 12 in FIG. 4. Cross pieces 14 in the form of square tubes extend horizontally between the upper ends of the legs 12. The machine is arranged generally into a magazine 16 which receives the envelopes that are to be sorted, an envelope feed station 18 at which the envelopes are separated from one another, a read station 20 at which a sort code imprinted on each envelope is read, and a storage section 22 which includes a plurality of individual storage bins 24 that receive the sorted envelopes. Panels such as those indicated at 25A and 25B cover the operating components of the machine.

In accordance with the present invention, the magazine 16 is provided with an improved screw conveyor for advancing the envelopes from the loading end of the magazine to the discharge end adjacent the feed station 18. The screw conveyor includes a first pair of horizontal rollers 26 and a second pair of horizontal rollers 28 which are located to one side of and parallel to rollers 26. Rollers 26 and 28 are mounted for rotation in the magazine 16 and extend lengthwise therein. Rollers 26 and 28 each have one end supported for rotation on a bar 30 secured to the frame of the machine. The opposite ends of the rollers are likewise journaled on the frame. The rotational axes of rollers 26 and 28 are located in a common horizontal plane.

Each roller 26 and 28 has a spiral groove 32 formed in its exterior surface and extending its entire length. The grooves 32 are tapered somewhat and are wide enough to receive the long lower edges of the envelopes which are loaded in the magazine.

Figure 5:
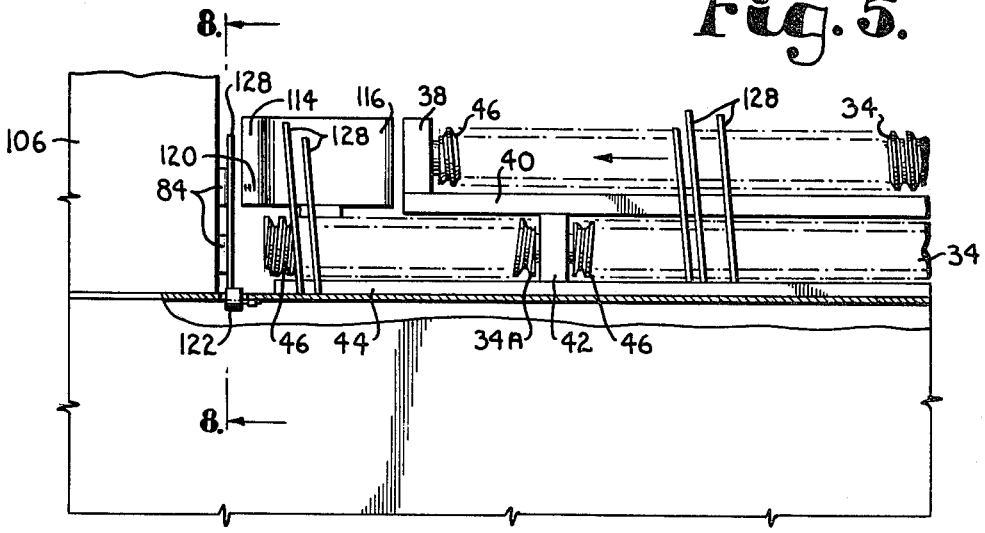
FIG. 5 is a fragmentary sectional view on an enlarged scale taken generally along line 5—5 of FIG. 1 in the direction of the arrows, with portions broken away for illustrative purposes.

The screw conveyor also includes a pair of raised rollers 34 which are parallel to rollers 26 and 28 but elevated slightly above the lower rollers. One end of each raised roller 34 is supported for rotation on a bar 36 which extends upwardly from one end of bar 30. As shown in FIG. 5, the opposite end of the upper roller 34 is journaled in a block 38 supported on a frame member 40. The lower roller 34 is journaled on a block 42 which extends between frame member 40 and another frame member 44. The downstream end of the lower roller 34 connects with a shorter roller 34A which forms an extension of roller 34.

The raised rollers 34 are located to one side of one of the lower rollers 28 such that rollers 28 are relatively close to the raised rollers while rollers 26 are remote from the raised rollers. The rotational axes of rollers 34 are located in a common vertical plane. Each of the raised rollers 34 has a spiral groove 46 extending along its length. Grooves 46 are identical to the grooves 32 in the lower rollers and are located to receive the vertical edges of the envelopes which are loaded onto rollers 26 and 28. A horizontal table surface 47 is located to one side of the screw conveyor in the magazine section of the machine.

As best shown in FIG. 4, the two rollers 26 are driven by a conventional electric motor 48. The motor is mounted on a vertical plate 50 which is secured to a square tube 56 forming part of the frame of the machine. Motor 48 drives a large sprocket 54 in the direction indicated by the directional arrow in FIG. 4. An endless chain 56 is drawn tightly around sprocket 54 and also around a pair of sprockets 58 which are secured to the ends of rollers 26. When motor 48 is activated, it drives sprockets 56 in the direction indicated by the arrows in FIG. 4.

The other set of lower rollers 28 and both of the raised rollers 34 are driven by another motor 60 mounted on a plate 62 secured to the frame of the machine. Motor 60 drives sprocket 64 in the direction indicated by the arrow. An endless chain 66 is drawn tightly around sprocket 64 and also around a pair of smaller sprockets 68 secured to the ends of rollers 28. A large gear 70 is mounted on a common shaft with one of the sprockets 68 and meshes with another gear 72 carried on the end portion of the lower roller 34. Each of the raised rollers 34 is provided with a sprocket 74, and a chain 76 is drawn tightly around the two sprockets 74 to drive rollers 34 in the direction indicated.

When motor 48 is activated, it rotates rollers 26 in a direction to carry their upper surfaces toward the raised rollers 34. When the other motor 60 is activated, it rotates the other set of rollers 28 in the same direction with their upper surfaces also moving toward the raised rollers 34. The raised rollers are driven by motor 60 in a direction to effect downward movement of the surfaces of rollers 34 which engage the envelopes. Rotation of the rollers advances the envelopes lengthwise along the magazine due to the spiral grooves. At the same time, the envelopes are maintained against the raised rollers 34 and in grooves 46 due to the direction of rotation of the lower rollers 26 and 28, while the envelopes are maintained down on the lower rollers and in grooves 32 due to the rotational direction of the raised rollers 34.

Motors 48 and 60 are controlled by switches which activate and deactivate the motors in a manner to prevent the envelopes from being angled or skewed as they approach the envelope feed station 18. The switch which controls motor 48 includes a switch arm 80 which is urged outwardly toward the extended position shown in FIG. 2. In this position, the left end portion of an envelope approaching the feed station on the screw conveyor engages arm 80 and depresses same to switch motor 48 to the deactivated condition, thereby stopping the rotation of rollers 26. The switch that controls the other motor 60 includes a somewhat longer switch arm 82 which is biased to the extended position shown in FIG. 2. The opposite or right end portion of an envelope approaching the feed station on the screw conveyor contacts and depresses switch arm 82, and depression of arm 82 switches motor 60 to the deactivated condition.

If the leading envelope on the magazine is skewed with its right end portion ahead of its left end portion, arm 82 will be depressed to deactivate motor 60 and thus stop rotation of rollers 28 and 34. Rollers 26 continue to advance the left end portion of the envelope until it depresses arm 80, at which time the envelope is at the feed station and is oriented perpendicular to the axes of the rollers. Conversely, if the envelope is skewed such that its left end portion is ahead of the right end portion, the left portion of the envelope depresses switch 80 and thereby stops the rotation of rollers 26 until the right end portion has caught up to the left end portion when the envelope reaches the feed station and depresses the other switch arm 82. In this manner, the switch arms 80 and 82 assure that the envelope will be oriented properly when it reaches the feed station of the machine. When both switch arms 80 and 82 are depressed by an envelope at the feed station, both motors 48 and 60 remain deactivated until the switch arms are released, at which time the motors are activated to convey the next envelope to the feed station.

Figure 8:
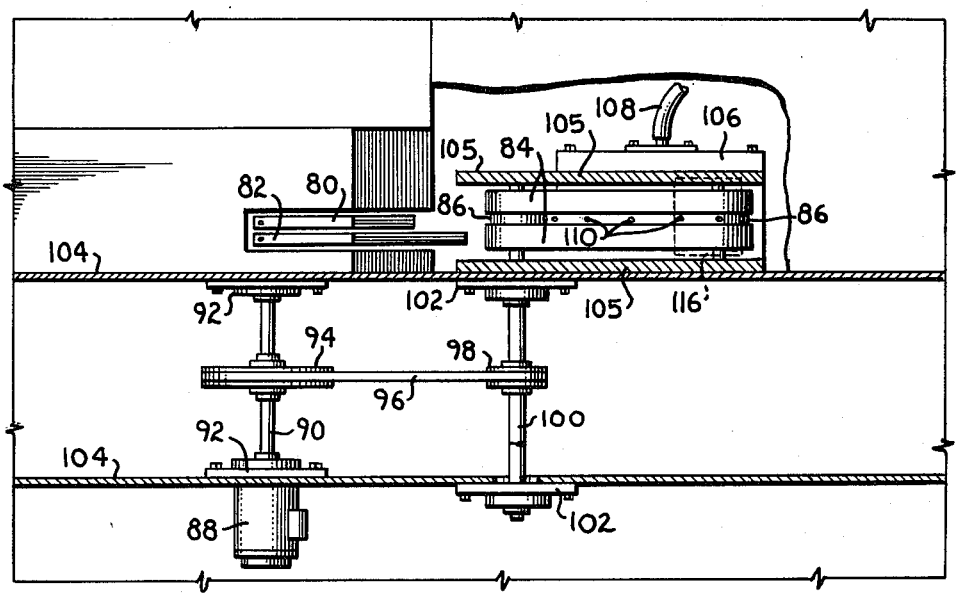
FIG. 8 is a fragmentary view on an enlarged scale taken generally along line 8—8 of FIG. 5 in the direction of the arrows, with portions broken away for illustrative purposes.

The machine is equipped with an improved pick off device which separates the leading envelope from the remaining envelopes and advances the envelopes individually toward the read station 20 of the machine. The pick off device includes a pair of endless belts 84 which are each drawn tightly around three pulleys 86. Two of the pulleys 86 are idler pulleys which are mounted for free rotation on the frame of the machine. As best shown in FIG. 8, the third pulley 86 is driven by a motor 88. The motor drives a shaft 90 which is supported by upper and lower bearings 92. Shaft 90 carries a large pulley 94 which receives an endless belt 96. Belt 96 is also drawn around a small pulley 98 which is secured to a vertical shaft 100 on which the driven pulley 86 is mounted. Shaft 100 is supported for rotation by upper and lower bearings 102 secured to frame panels 104. Motor 88 thus drives belts 84 in the direction indicated by the arrows in FIG. 2.

Belts 84 are spaced vertically apart from one another to present a gap between them. The front surfaces of the belts provide the conveying surfaces which are oriented perpendicular to the axes of rollers 26 and 28 and which receive the envelopes discharged from the screw conveyor. Guide bars 105 (FIG. 8) above and below belts 84 assist in guiding the envelopes as they are advanced by the belts.

The envelopes are drawn against the conveying surfaces of belts 84 by a relatively strong suction force applied to the gap between the belts by a vacuum box 106. A vacuum pump (not shown) applies a vacuum to the vacuum box 106 through a hose 108 (FIG. 8). The front surface of the vacuum box 106 is provided with a series of openings 110 located in the gap presented between belts 84. The suction force thereby applied between the belts draws the leading envelope off of the envelope supply and against the conveying surfaces of belts 84.

Figure 6:
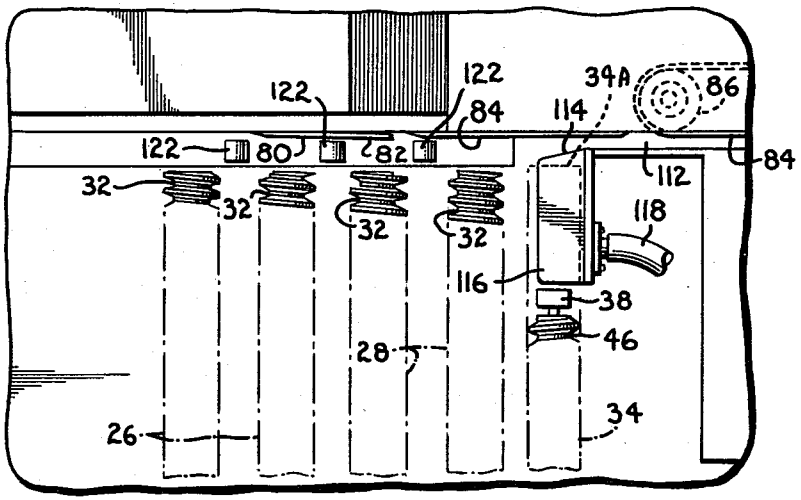
FIG. 6 is a fragmentary top plan view on an enlarged scale of the envelope feed station and the adjacent end portion of the magazine.
Figure 7:
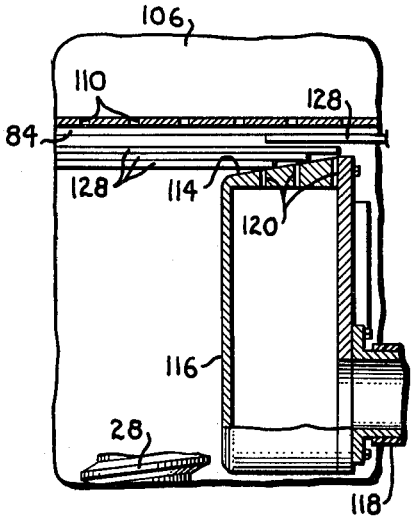
FIG. 7 is a fragmentary top plan view on a still larger scale of the pick off device at the feed station, with portions broken away for illustrative purposes.

The pick off device advances the envelopes individually through a guideway 112 which is formed on the machine to receive the individual envelopes in a vertical orientation. As best shown in FIGS. 6 and 7, the entrance to guideway 112 is formed by the conveying surfaces of belts 84 on one side and on the other side by a beveled surface 114 of another vacuum box 116. The beveled surface 114 is angled relative to the opposing surfaces of belts 84 in converging fashion such that the right or downstream portion of surface 114 is closer to the belts than the left or upstream portion. A vacuum pump (not shown) applies a vacuum to vacuum box 116 through a hose 118. The vacuum box 116 is located immediately beyond the end of the upper raised roller 34 and above the lower raised roller 34.

As best shown in FIG. 7, the vacuum which is applied to the vacuum box 116 is transmitted to the beveled surface 114 through a series of passages 120 extending from the interior of the vacuum box to the beveled surface. The suction force applied to surface 114 is of considerably less intensity than the suction force applied to the gap between belts 84 through openings 110. Consequently, the leading envelope is normally drawn against belts 84 due to the greater intensity of the suction force at box 106 as compared to the suction force at box 116.

Three small bushings 122 are mounted for rotation immediately downstream of the discharge end of the screw conveyor in magazine 16. The bushings 122 are freely rotatable and receive the long lower edges of the envelopes which are delivered to the feed station 18. Bushings 122 provide a low friction surface which supports the advancement of the envelopes by belts 84 in an improved manner in comparison to another type of surface.

Downstream of the envelope feed station 18, the mail sorting machine is constructed in substantially the same manner as disclosed in the aforementioned Akers application to which reference can be made for a detailed description of the downstream components of the machine. These components serve to convey the envelopes individually in succession through the guideway 112 and past the read station 20 onto a table surface 124 extending between the opposite banks of supporting bins 24. The sorting equipment activates selected diverter gates (a pair of which are indicated at 126 in FIG. 1) in order to divert the envelopes into the appropriate bins 24.

Figure 3:
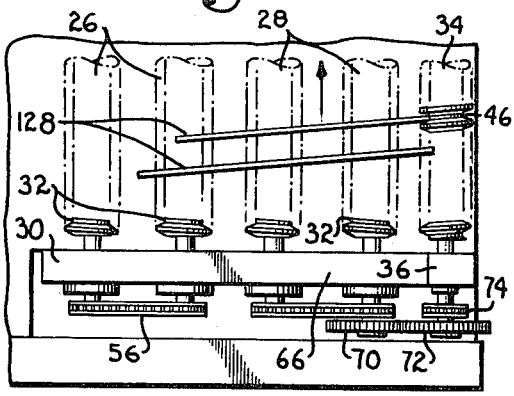
FIG. 3 is a fragmentary top plan view on a still larger scale showing the end portion of the magazine opposite the feed station.

In operation of the machine, envelopes 128 are loaded onto the upstream end of magazine 16 which is the lower end of the magazine as viewed in FIG. 1. Each envelope is loaded in a vertical orientation with its long bottom edge on top of the lower rollers 26 and 28 of the screw conveyor, as best shown in FIGS. 3 and 5. One vertical edge of each envelope 128 engages the two raised rollers 34 and fits in their spiral grooves 46 to maintain the envelopes in a vertical orientation. The lower edges of the envelopes fit in the spiral grooves 32 of the lower rollers 26 and 28. The envelopes can be loaded onto the magazine in a stack, or they can be separated from one another. In any event, the lower edges of the envelopes naturally enter the tapered grooves 32.

The drive motors 48 and 60 of the screw conveyor turn rollers 26, 28 and 34 in a direction to convey the envelopes along the spiral grooves 32 and 46. As indicated by the directional arrow in FIG. 2, the envelopes are conveyed lengthwise along the rollers and are maintained in a vertical orientation by the spiral grooves 46 in the raised rollers 34. The surfaces of the raised rollers which engage the envelopes move downwardly to assure that the envelopes will be held down on the lower rollers 26 and 28. The upper surfaces of the lower rollers move toward the raised rollers to maintain the vertical edge of each envelope against the raised rollers.

The envelopes are discharged from the screw conveyor one by one onto the rotatable bushings 122 with one flat side of the leading envelope drawn against the conveying surfaces of belts 84 due to the suction effect provided by the vacuum box 106. As previously indicated, the switch arms 80 and 82 control the drive motors of the screw conveyor in a manner to assure that each envelope 128 is oriented properly to position its flat side against the conveying belts 84. If one end of the envelope is appreciably ahead of the opposite end, the appropriate switch arm 80 or 82 is depressed by the leading end portion of the envelope to deactivate the corresponding drive motor and permit the opposite end portion to catch up at the time the envelope is discharged from the screw conveyor. At the time the leading envelope is discharged onto bushings 122, both switch arms 80 and 82 are depressed and both drive motors 48 and 60 are deactivated.

Figure 2:
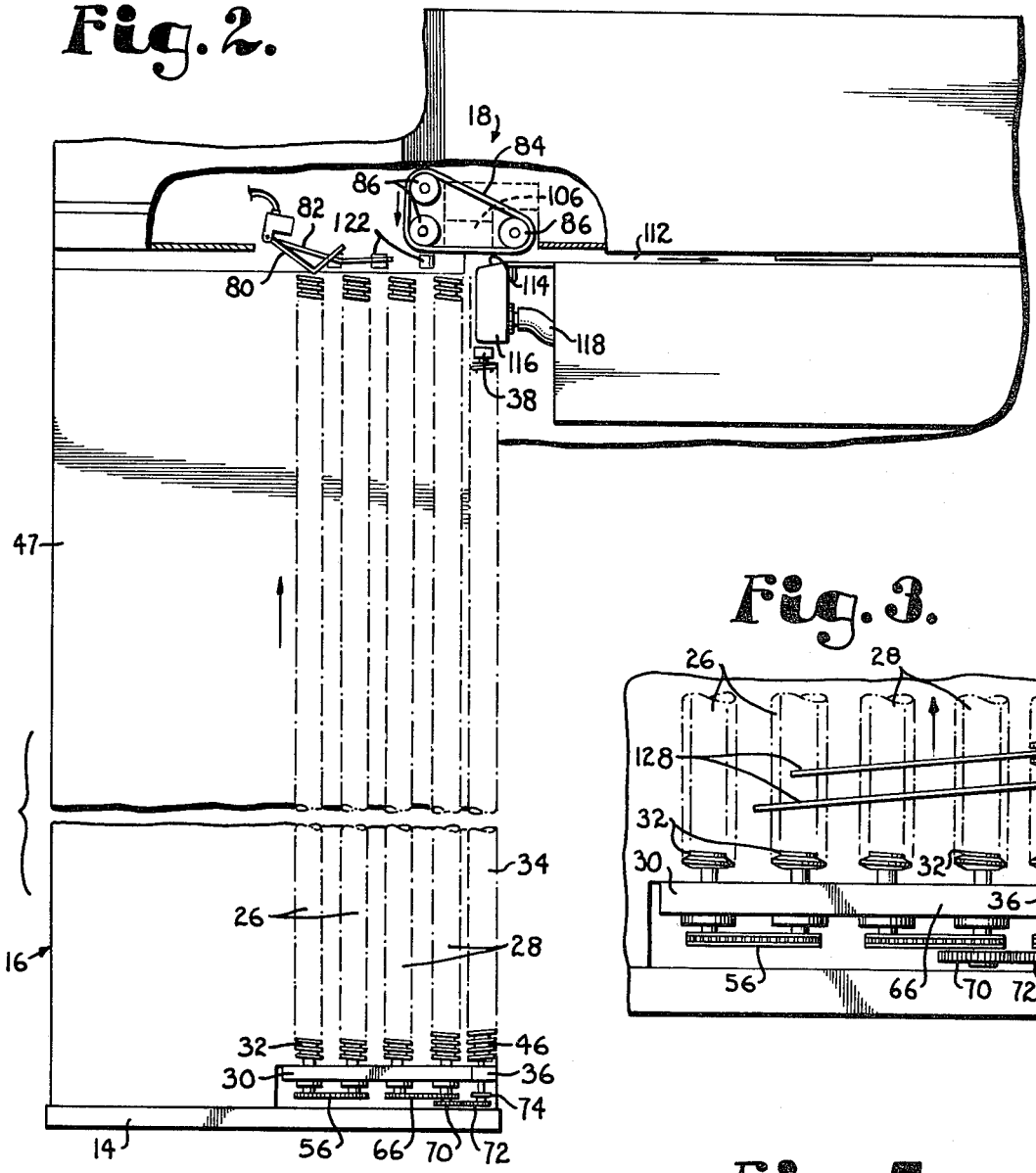
FIG. 2 is a fragmentary top plan view on an enlarged scale of the magazine section and envelope feed station of the machine, with portions broken away for illustrative purposes and the break lines indicating continuous length.

Motor 88 drives belts 84 in a direction to convey the leading envelope from left to right as viewed in FIGS. 1 and 2 into the guideway 112. If only a single envelope is positioned against belts 84 as intended, the relatively strong suction force provided by vacuum box 106 holds the envelope against belts 84 against the weaker suction force provided by the opposing vacuum box 116. However, if one or more extra envelopes stick to the side of the leading envelope opposite the side which engages belts 84, the leading envelope shields the extra envelopes from the openings 110 which transmit the suction force provided by vacuum box 106. The extra envelopes are exposed to the opposing vacuum box 116 which applies a suction force sufficient to draw the extra envelopes away from the leading envelope and against the beveled surface 114 of box 116. In this manner, any extra envelopes adhering to the leading envelope are stripped away from it such that only the leading envelope is conveyed through guideway 112.

In the event that more than one extra envelope sticks to the leading envelope, the angled orientation of surface 114 with respect to belts 84 is important in assuring that all of the extra envelopes are stripped from the leading envelope. With particular reference to FIG. 7, the angled orientation of surface 114 causes the extra envelopes to be drawn against it in a staggered shingle arrangement. The leading end portions of all of the extra envelopes are exposed to the suction force transmitted through passages 120, and the extra envelopes are thereby drawn against surface 114 in the shingle pattern shown in FIG. 7. Once the leading envelope has cleared openings 110, the first extra envelope is exposed to the suction force transmitted through openings 110 and is thereby drawn against the belts. The remaining extra envelopes remain shielded from openings 110 and are held against surface 114 by the suction force transmitted through passages 120. As long as at least one envelope is held against surface 114, the switch arms 80 and 82 remain depressed to maintain the drive motors 48 and 60 of the screw conveyor in a deactivated condition. Once the extra envelopes have all been transported by belts 84 into guideway 112, switch arms 80 and 82 are released and the drive motors are activated to advance the next envelope against conveyor belts 84.

After being discharged into guideway 112, the individual envelopes are conveyed in succession past the read station 20 in a vertical orientation. A reading device (not shown) at the read station reads the sort code imprinted on the envelope and informs the control circuitry of the machine, which then activates the appropriate diverter gate 126 to deflect the envelope into the appropriate sorting bin 24.

It is thus apparent that the present invention provides an improved screw conveyor in the magazine section of the machine which is capable of handling envelopes of various sizes due to the arrangement of the rollers. The improved pick off device at the envelope feed station is likewise able to readily handle envelopes of diverse size. Together, the screw conveyor and pick off device cooperate to efficiently convey the envelopes in the proper orientation while assuring that they are separated from one another for individual processing.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. In a mail sorting machine having a magazine section for receiving a supply of envelopes and delivering the envelopes to a feed station at which the envelopes are separated individually from the envelope supply, an improved conveyor comprising:

a plurality of generally horizontal rollers mounted on the magazine section of the machine for rotation about substantially parallel axes located in a common horizontal plane, said rollers being located to receive the envelope supply with the lower edge of each envelope on the rollers and the envelopes oriented substantially vertical, said horizontal rollers being arranged to present first and second sets thereof;

a spiral groove in each roller for receiving the lower edges of the envelopes, said grooves being arranged to convey the envelopes lengthwise along the rollers toward the feed station of the machine in response to rotation of the rollers;

at least one raised roller mounted on the magazine section of the machine for rotation about an axis oriented generally parallel to the rotational axes of said horizontal rollers, said raised roller being elevated relative to said horizontal rollers at a location to engage a vertical edge of each envelope loaded on the horizontal rollers, said raised roller being adjacent said first set of horizontal rollers and being remote from said second set of horizontal rollers;

a spiral groove in said raised roller arranged to receive said vertical edges of the envelopes to assist in conveying the envelopes and maintaining the vertical orientation thereof; and drive means for effecting rotation of each roller to convey the envelopes along the magazine section to the feed station of the machine, said drive means including first power means operable to effect rotation of said first set of horizontal rollers and said raised roller when activated and second power means operable to effect rotation of said second set of horizontal rollers when activated.

2. A conveyor as set forth in claim 1, including:

a second raised roller mounted in the magazine section of the machine for rotation about an axis substantially parallel to and in a common vertical plane with the rotational axis of said one raised roller, said second raised roller being elevated relative to said horizontal rollers at a location to engage the same vertical edges of the envelopes engaged by said one raised roller; and a spiral groove in said second raised roller arranged to receive said vertical edges of the envelopes to assist in conveying the envelopes and maintaining the vertical orientation thereof, said first power means being operable to rotate said second raised roller.

3. A conveyor as set forth in claim 2, wherein said drive means is arranged to rotate the raised rollers in a direction to effect downward movement of the surfaces thereof which engage the envelopes.

4. A conveyor as set forth in claim 3, wherein said drive means is arranged to rotate said horizontal rollers in a direction to move the upper surfaces thereof toward the raised rollers.

5. A conveyor as set forth in claim 1, wherein:

said drive means is arranged to rotate said horizontal rollers in a direction to move the upper surfaces thereof toward said raised roller; and said drive means is arranged to rotate said raised roller in a direction to effect downward movement of the surface thereof which engages the envelopes.

6. A conveyor as set forth in claim 1, including:

first switch means for deactivating said first power means when an envelope approaching the feed station has the vertical edge engaged by said raised roller in a leading position relative to the opposite vertical edge, thereby stopping rotation of said first set of horizontal rollers and said raised roller to permit said opposite vertical edge to catch up to the other vertical edge; and second switch means for deactivating said second power means when an envelope approaching the feed station has said opposite vertical edge in a leading position relative to the other edge, thereby stopping roration of said second set of horizontal rollers to permit the other vertical edge to catch up to said opposite edge.

* * * * *